United States Patent [19]

Crosato et al.

[11] Patent Number: 5,046,347

[45] Date of Patent: Sep. 10, 1991

[54] COOLANT CONTAINMENT APPARATUS FOR ROLLING MILLS

[75] Inventors: Bruno Crosato, Kingston; Gordon Harrison, Napanee, both of Canada

[73] Assignee: Alcan International Limited, Montreal, Canada

[21] Appl. No.: 419,099

[22] Filed: Oct. 10, 1989

[51] Int. Cl.[5] ..... B21B 27/06; B21B 45/02

[52] U.S. Cl. ..... 72/201; 72/236

[58] Field of Search ..... 72/39, 40, 44, 45, 201, 72/236

[56] References Cited

U.S. PATENT DOCUMENTS

| | | | |
|---|---|---|---|
| 1,994,691 | 3/1935 | Dahl et al. | 72/236 |
| 2,056,433 | 10/1936 | Matthews | 72/201 |
| 2,849,905 | 9/1958 | Heinz | 72/201 |
| 3,192,752 | 7/1965 | Dowd et al. | 72/45 |
| 3,225,580 | 12/1965 | El-Waziri | 72/236 |
| 3,540,527 | 11/1970 | Grenfell | 72/201 X |
| 3,994,151 | 11/1976 | Stock et al. | 72/201 |
| 4,061,010 | 12/1977 | Stock et al. | 72/201 |
| 4,272,976 | 6/1981 | Pizzedaz | 72/201 X |
| 4,400,961 | 8/1983 | Schaming | 72/201 |
| 4,552,003 | 11/1985 | Kolecki | 72/38 |
| 4,619,126 | 10/1986 | Kolecki | 72/38 |
| 4,671,091 | 6/1987 | Atack et al. | 72/201 X |
| 4,691,549 | 9/1987 | Adair | 72/38 |
| 4,709,568 | 12/1987 | Ticehurst et al. | 72/201 |
| 4,718,264 | 1/1988 | Guppy et al. | 72/201 |
| 4,934,444 | 6/1990 | Frischknecht et al. | 72/201 X |

FOREIGN PATENT DOCUMENTS

| | | | |
|---|---|---|---|
| 1924319 | 11/1970 | Fed. Rep. of Germany | 72/201 |
| 1069892 | 1/1984 | U.S.S.R. | 72/201 |

*Primary Examiner*—E. Michael Combs

*Attorney, Agent, or Firm*—Cooper & Dunham

[57] ABSTRACT

Coolant containment apparatus for a rolling mill in which aqueous coolant liquid is sprayed onto the upper and lower work roll surfaces by upper and lower spray heads only on the exit side of the mill, including an enclosure maintained at subatmospheric pressure and surrounding the upper spray head and adjacent upper work roll and backup roll surfaces, upper and lower air dam members extending along the edges of the enclosure above and below the spray head to define narrow air gaps at the roll surfaces, slippers connected to ends of the dam members and in rubbing contact with the rolls to maintain the gap widths constant, and seal members mounted on the roll supports at the ends of the mill and cooperating with the enclosure to confine the enclosure interior. A wiper removes coolant liquid from the upper work roll on the entry side of the mill, while collectors catch and remove coolant spraying through the ends of the roll bite at the exit side of the mill, and air is blown into the roll bite on the exit side to move coolant liquid from the surface of an emerging rolled metal strip into the collectors. Below the mill pass line, a shield protects the rolled metal strip from coolant from the lower spray head.

20 Claims, 4 Drawing Sheets

COOLANT CONTAINMENT APPARATUS FOR ROLLING MILLS

BACKGROUND OF THE INVENTION

This invention relates to rolling mills for reducing metal, and more particularly to apparatus for containing coolant liquid applied to the rolls of such mills. Typically, a mill as herein contemplated comprises upper and lower work rolls between which the metal to be reduced passes (e.g. in sheet or strip form), and upper and lower backup rolls respectively above and below (and in contact with) the upper and lower work rolls.

In an important specific sense, the invention is concerned with improvements in and/or modifications of the apparatus described in U.S. Pat. Nos. 3,994,151 and 4,061,010, the disclosures of which are incorporated herein by this reference. As in those patents, the invention will be particularly described as employed in the cold rolling of aluminum sheet or strip, the term "aluminum" being used herein to refer to aluminum-based alloys as well as pure aluminum metal. It will be appreciated, however, that the invention in its broader aspects is applicable to any type of rolling mill for reducing metal wherein coolant is applied to the mill rolls and wherein contact of the coolant with surfaces of the metal being reduced is to be avoided or minimized.

The aforementioned patents explain that, in rolling operations such as cold rolling of sheet aluminum, it is necessary to cool the mill rolls by applying thereto copious quantities of coolant liquid, typically also containing a lubricant. As the patents further explain, it is advantageous from an operational standpoint to use water as the coolant, or a water-based coolant/lubricant system. Metals such as aluminum, however, are subject to unacceptable surface staining if appreciable quantities of the water or water-based coolant come into and remain in contact with the surfaces of the reduced metal strip emerging from the mill.

The aforementioned patents describe coolant application and containment systems for preventing aqueous liquid coolant from falling and/or splashing on the strip surfaces as and after the strip emerges from the mill roll bite. Stated broadly, these systems include upper and lower coolant-applying spray heads respectively disposed to direct the coolant spray onto the surfaces of the upper and lower work rolls only on the exit side of the mill (the side from which the reduced metal strip emerges), and upper and lower casings or enclosures respectively surrounding the upper and lower spray heads and at least adjacent portions of the roll surfaces. The sprayed coolant collects in and is drained from the enclosures.

In one such arrangement shown in the patents, the upper enclosure has upper and lower horizontal edges extending in close but spaced relation to the upper backup and work roll surfaces so as to define therewith narrow gaps extending lengthwise of the rolls respectively above and below the upper spray head on the exit side of the mill. The directions of roll surface movement past the two gaps are both into the enclosure; and the interior of the enclosure is kept at subatmospheric pressure, to create constant inward flows of air through the gaps, for cooperating with the inwardly directed roll surface movement in preventing escape of coolant water from the enclosure. The vertical end walls of the enclosure, adjacent the ends of the rolls, may have edges conforming generally to (but spaced slightly from) the roll surfaces and may optionally bear spring-loaded rubbing seals. A similar enclosure may be provided for the lower spray head and the lower work and backup rolls.

Athough the arrangement just described offers significant advantages for coolant containment, it has been difficult to attain continuous trouble-free operation with embodiments of this system heretofore constructed, and the use of such embodiments has been attended with high maintenance costs. Particular problems have been encountered in achieving and maintaining a proper gap width, which is essential to satisfactory performance. In addition, the design of these prior embodiments of the system does not readily accommodate changes in roll diameter, as are commonly necessary in rolling mills. It would be desirable to provide coolant containment apparatus, generally in accordance with the aforementioned patents, affording ease of installation and maintenance, improved reliability, convenient adaptability to a practicable range of differing roll diameters, and enhanced protection of the rolled strip against stain-producing deposits of coolant liquid.

SUMMARY OF THE INVENTION

The present invention broadly contemplates the provision of improved coolant containment apparatus in a rolling mill that includes upper and lower work rolls defining a roll bite through which metal is passed, for reduction, from an entry side to an exit side of the mill; at least one backup roll, in contact with the upper work roll along a line of contact; means supporting the backup and work rolls; and means for applying liquid coolant to the outer surface of the upper work roll on only the exit side of the mill above the roll bite.

In common with apparatus disclosed in the aforementioned U.S. Pat. Nos. 3,994,151 and 4,061.010, the coolant containment apparatus of the invention has enclosure means disposed on the exit side of the mill, generally surrounding the coolant-applying means and open toward the outer surface of the upper work roll, for confining a region containing the coolant-applying means and adjacent surface portions of the backup roll and the upper work roll so as to restrict fluid flow into and out of such region, the enclosure means having upper and lower edges respectively facing the backup roll and the upper work roll; vacuum means for withdrawing air from the interior of the enclosure to maintain a subatmospheric air pressure in the confined region; and means for collecting and withdrawing coolant liquid from the interior of the enclosure.

As particular features of the invention, there are provided, in combination, a rigid upper air dam member disposed at the upper edge of the enclosure means and extending, parallel to the axis of the backup roll, in closely adjacent but spaced relation to the outer surface thereof, above the coolant-applying means, over substantially the entire length of the backup roll, for defining therewith a narrow gap through which air is drawn into the confined region over the backup roll outer surface when the confined region is at a subatmospheric pressure; a rigid lower air dam member disposed at the lower edge of the enclosure means and extending, parallel to the axis of the upper work roll, in closely adjacent but spaced relation to the outer surface of the upper work roll, below the coolant-applying means but above the roll bite, over substantially the entire length of the upper work roll, for defining therewith a narrow gap through which air is drawn into the confined region over the work roll outer surface when the interior of the confined region is at a subatmospheric pressure; a first pair of slippers, connected to and respectively disposed at opposite ends of the upper air dam member in rubbing contact with the backup roll outer surface, for maintaining the upper air dam member at a constant spacing from the backup roll; and a second pair of slippers, connected to and respectively disposed at opposite ends of the lower air dam member in rubbing contact with the work roll outer surface, for maintaining the lower air dam member at a constant spacing from the upper work roll.

In this combination of elements, the lower air dam member may comprise a pair of interconnected, vertically spaced plates. Each of the slippers may have a sole fabricated of polytetrafluoroethylene for engaging the roll surface with which the slipper is in rubbing contact. Means may be provided for moving the upper and lower air dam members with their associated pairs of slippers in directions transverse to the lengths of the air dam members to enable use of the apparatus with rolls of differing diameters.

As a further feature of the invention, a pair of seal members are mounted on the roll-supporting means of the mill and respectively disposed at opposite ends of the upper work roll. Each of the seal members is in rubbing contact with an end portion of the work roll outer surface and an adjacent end surface of the backup roll at and adjacent the line of backup roll-work roll contact, for cooperating with the enclosure means in confining the aforesaid region. Conveniently or preferably, each of the seal members is fabricated of fiber-reinforced polytetrafluoroethylene; also, advantageously, each of the seal members has an arcuate lower surface for engaging the outer surface of the upper work roll and a centrally disposed, downwardly-opening notch into which can be fitted a spacer to provide a seal at the chamfered end of the work roll.

Still further features of the invention include flexible wiper means disposed in rubbing contact with the work roll outer surface on the entry side of the mill along substantially the entire length of the upper work roll for removing liquid coolant from the work roll outer surface; and a pair of spray collector means respectively disposed adjacent opposite ends of the roll bite on the exit side of the mill for collecting liquid coolant, emerging as a spray from the roll bite outwardly of the metal being reduced in the mill, to shield the metal from contact with the spray. Each of the spray collector means advantageously comprises a rigid plate mounted for movement lengthwise of the roll bite, and a generally U-shaped flexible wall opening toward the roll bite and having opposite ends respectively anchored to the rigid plate and fixedly mounted adjacent the proximate end of the roll bite, the plate being positionable adjacent but outwardly of a lateral edge of the metal being reduced in the mill and being adjustable in position to accommodate various widths of metal being reduced.

As an additional feature of the invention, blow-off means are disposed on the exit side of the mill for directing a flow of air into the roll bite above the metal being reduced, to blow any coolant liquid carried on the upper surface of the metal into the collector means, which are arranged to receive coolant liquid blown from the metal surface by the blow-off means. The blow-off means may comprise a plurality of nozzles mounted on the enclosure means adjacent the lower edge thereof for blowing compressed air into the roll bite, the nozzles being disposed and arranged to provide a flow of compressed air over substantially the full length of the roll bite.

Particular embodiments of the coolant containment apparatus of the invention, for use in a mill that includes means for applying liquid coolant to the outer surface of the lower work roll on only the exit side of the mill below the roll bite, additionally incorporate a rigid shield member extending, parallel to the axis of the lower work roll, in closely spaced relation to the outer surface of the lower work roll along substantially the entire length thereof between the roll bite and the means for applying coolant to the lower work roll outer surface, to shield the metal being reduced from liquid from the last-mentioned coolant applying means. A pair of pads may be connected to the shield member respectively adjacent opposite ends of the shield member and in rubbing contact with the lower work roll outer surface, for maintaining the shield member at a constant spacing from the lower work roll outer surface. The shield member may be of L-shaped cross-section; in addition, the apparatus may include means pivotally mounting the shield member for movement transversely of its length, again to enable use of the apparatus with rolls of different diameters.

Further features and advantages of the invention will be apparent from the detailed description hereinbelow set forth, together with the accompanying drawings.

DETAILED DESCRIPTION

Figure 1:
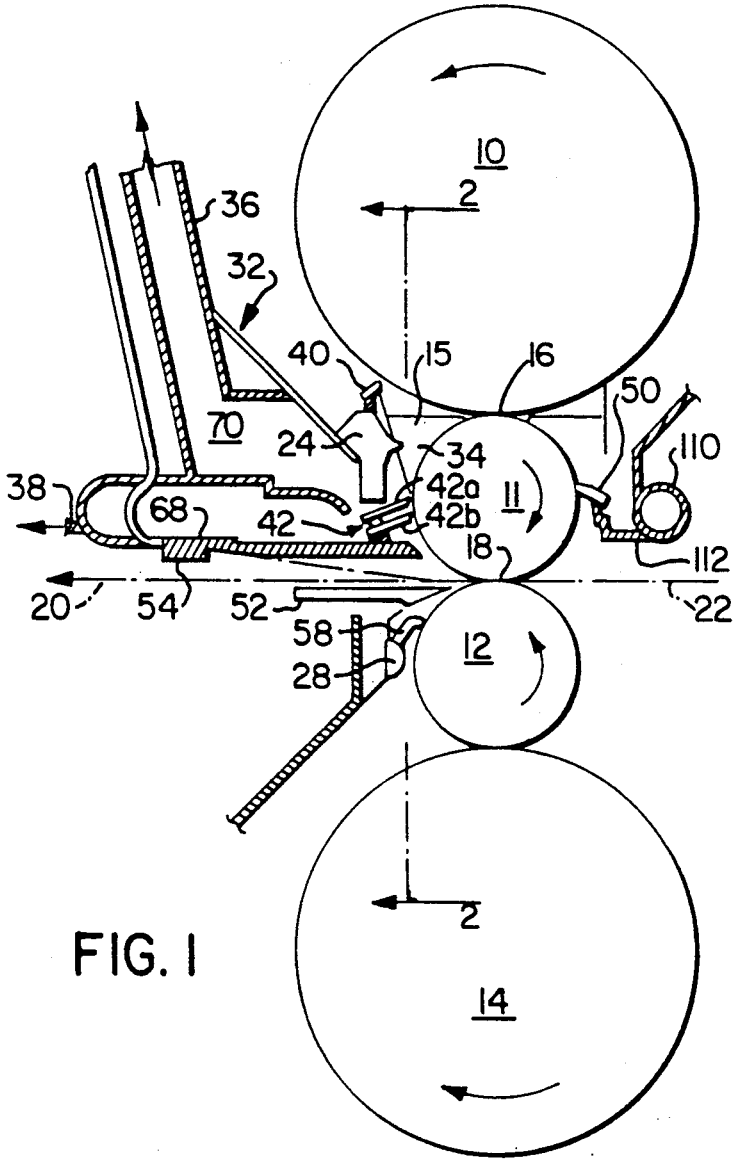
FIG. 1 is a simplified, schematic, end elevational view of a rolling mill incorporating an illustrative embodiment of the apparatus of the invention.

For purposes of illustration, the invention will be described as incorporated in a cold-rolling mill for aluminum sheet or strip, shown schematically in FIG. 1. The mill of FIG. 1 includes an upper backup roll 10, an upper work roll 11, a lower work roll 12, and a lower backup roll 14, journaled at their ends in suitable support structure 15 and arranged to be driven (by means also not shown) in the directions indicated by arrows on the rolls. These four rolls are arranged one above another, for rotation about parallel horizontal axes, with the upper backup and work rolls in contact along a line of contact 16 and the lower backup and work rolls similarly in contact. The two work rolls 11 and 12 define a nip or roll bite 18 between them, through which a strip of sheet aluminum metal to be reduced is advanced (from right to left in FIG. 1, i.e. in the direction of arrow 20) along a typically planar path or pass line 22. As the aluminum strip passes through the roll bite, it is reduced in thickness by pressure exerted on it by the rolls.

The arrangement, mounting and operation of the mill rolls shown in FIG. 1 may be entirely conventional, and as such need not be further described. Ordinarily, the mill is arranged to enable replacement of the rolls with rolls of somewhat different diameter, as is well known in the art; for example, the mill may be designed to accommodate work rolls of diameters ranging from 19 to 21 inches. The diameters of the two work rolls employed for any given rolling operation are typically equal to each other but substantially smaller than the backup roll diameters. The axial length of the work rolls is greater than the width of the aluminum strip being reduced, while the backup rolls are slightly shorter than the work rolls (which have chamfered ends) and are centered with respect thereto.

For convenience, the side of the mill at which the strip to be reduced enters the roll bite 18 will be referred to as the entry side of the mill, and the side of the mill at which the reduced strip emerges from the roll bite will be referred to as the exit side. In FIG. 1, the entry side is on the right, and the exit side is on the left, of the rolls.

As is described in the aforementioned U.S. Pat. Nos. 3,994,151 and 4,061,010, means are provided for spraying the outer surfaces of both work rolls 11 and 12 with a copious supply of aqueous coolant liquid (with which a lubricant may be admixed) at least substantially along the full lengths of the rolls, but only on the exit side of the mill. These means are shown in FIG. 1 as an upper spray head 24, with a plurality of vertically spaced rows of nozzles 26 (FIG. 2) facing and extending lengthwise of the upper work roll for spraying the upper work roll surface, and a lower spray head 28 also having a plurality of vertically spaced, horizontally extending rows of nozzles 30 (FIG. 12) for spraying the lower work roll and backup roll.

The apparatus of the present invention, in the embodiment now to be described, is arranged to minimize exposure of the reduced metal strip (as and after it emerges from the roll bite 18) to sprayed aqueous coolant liquid from the heads 24 and 28, and thereby to protect the strip from the deleterious effects (in particular, surface staining) that result from such contact of the strip with coolant. To this end, referring again to FIG. 1, the apparatus includes enclosure structure 32 disposed on the exit side of the mill, generally surrounding the upper spray head 24 and open toward the upper work roll 11, for confining a region 34 containing the head 24 and adjacent surface portions of the upper backup roll 10 and upper work roll 11 so as to restrict fluid flow into and out of that region. The upper and lower edges of the enclosure (further described below) respectively face, and extend along, the rolls 10 and 11 on the mill exit side, respectively above and below the head 24. The enclosure is provided with a vacuum duct 36 connected to a suitable pump or the like (not shown) for withdrawing air from the region 34 to maintain a subatmospheric air pressure therein, and a drain 38 for collecting and withdrawing coolant liquid from the interior of the enclosure. Insofar, the enclosure corresponds generally to that of the coolant containment system of the aforementioned patents.

As a particular feature of the present invention, in its illustrated embodiment, a rigid upper air dam member 40 is disposed at the upper edge of the enclosure 32 and extends, parallel to the axis of the backup roll 10, in closely adjacent but spaced relation to the outer surface of that backup roll, above the spray head 24, over substantially the entire length of roll 10, for defining therewith a narrow gap through which air is drawn into the confined region 34 over the backup roll surface when the region is at a subatmospheric pressure; and a rigid lower air dam member 42 is disposed at the lower edge of the enclosure and extends, parallel to the axis of the upper work roll in closely adjacent but spaced relation to the outer surface of the upper work roll, below the spray head 24 but above the roll bite 18, over substantially the entire length of the upper work roll, for defining therewith a narrow gap through which air is drawn into the confined region 34 over the work roll outer surface when the interior of region 34 is at a subatmospheric pressure.

Further in accordance with the invention, two slippers 44, 44 (FIGS. 2 and 3) are connected to and respectively disposed at opposite ends of the upper air dam member 40 in rubbing contact with the outer surface of the backup roll 10 for maintaining the upper air dam member at a constant spacing from the backup roll; and two more slippers 46, 46 (FIGS. 2–5) are connected to and respectively disposed at opposite ends of the lower air dam member 42 in rubbing contact with the outer surface of the work roll 11, for maintaining the lower air dam member at a constant spacing from the work roll.

As an additional feature of the invention, two seal members 48, 48 (FIGS. 1 and 6–9) are mounted on the support structure 15 for the mill rolls (e.g., on the upper backup roll chocks) and respectively disposed at opposite ends of the upper work roll 11. Each of these seal members is in rubbing contact with an end portion of the outer surface 11*a* of the upper work roll 11 and with an adjacent end surface 10*a* of the upper backup roll 10 at and adjacent the line 16 of contact between the rolls, for cooperating with the enclosure 24 in confining the region 34 as described above.

The apparatus of the invention in its illustrated embodiment also includes a flexible wiper 50 (FIGS. 1 and 12) in rubbing contact with the outer surface of the upper work roll 11 on the entry side of the mill along substantially the entire length of the work roll 11 for removing liquid coolant from the work roll surface; a pair of spray collectors 52 (FIGS. 1, 10 and 12) respectively disposed adjacent opposite ends of the roll bite 18 on the exit side of the mill for collecting liquid coolant, emerging as a spray from the roll bite outwardly of the metal being reduced in the mill, to shield the metal from contact with the spray; and blow-off elements 54 (FIGS. 1, 3 and 11) disposed on the exit side of the mill for directing a flow of air 56 into the roll bite above the metal being reduced, to blow any coolant liquid carried on the upper surface of the metal into the collectors 52, which are arranged to receive coolant liquid blown from the metal surface by the blow-off elements.

In addition, the illustrated embodiment of the invention includes a rigid shield member 58 (FIGS. 1, 12 and 13) extending, parallel to the axis of the lower work roll 12, in closely spaced relation to the outer surface of the work roll 12 along substantially the entire length thereof between the roll bite 18 and the lower spray head 28, to shield the metal being reduced from liquid from head 28.

Figure 2:
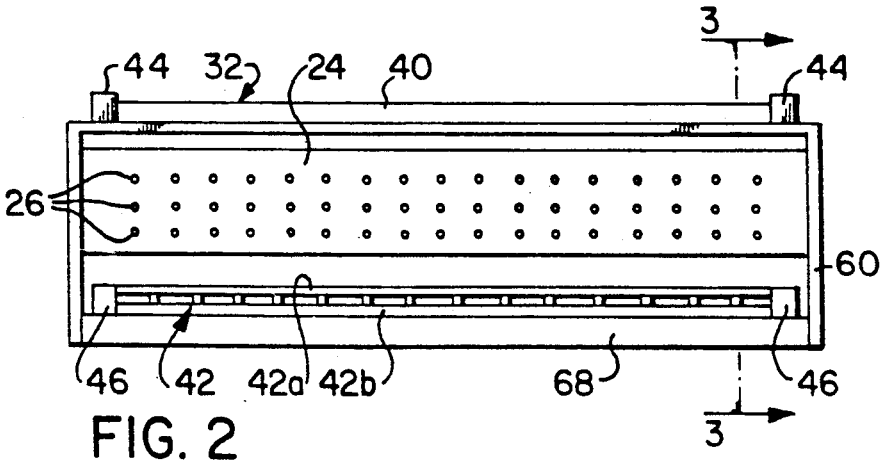
FIG. 2 is a simplified, schematic, side elevational view of a portion of the apparatus of FIG. 1, including the enclosure for the head for applying coolant to the upper work roll, taken as along the line 2—2 of FIG. 1, but somewhat enlarged.
Figure 3:
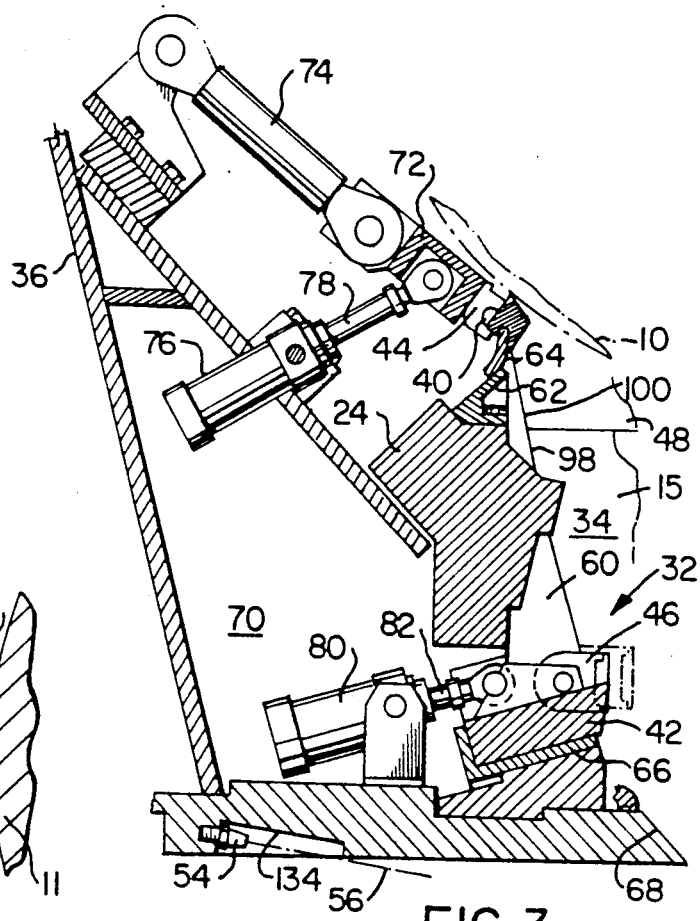
FIG. 3 is a further enlarged sectional elevational view of the same portion of the apparatus, and associated elements, taken as along the line 3—3 of FIG. 2.

Referring now more particularly to FIGS. 2 and 3, it will be seen that the enclosure 32 includes opposed end walls 60 which cooperate with the mill roll support structure 15 and the seal members 48 to enclose, substantially completely, the opposite ends of the confined region 34. The upper spray head 24, mounted within the enclosure and extending between these end walls, bears along its top edge a horizontally extending bracket 62, against which rests the lower edge portion of a horizontally extending flexible seal 64 having its upper edge secured to the upper air dam member 40. The lower air dam member 42 rests in a slideway 66 also mounted in the enclosure 32, and below the slideway the bottom wall 68 of the enclosure cooperates with other wall structure to enclose the rear chamber 70 of the confined region 34. Sprayed liquid coolant from head 24 can pass between the lower edge of the head and the lower air dam member into chamber 70, where it collects and (as best understood from FIG. 1) passes to the drain 38.

The upper air dam member 40 is supported, for transverse movement toward and away from the upper backup roll 10, by a pair of mounting assemblies respectively disposed at its opposite ends. Each such assembly comprises a bar 72 connected to the dam member; an arm 74, pivotally connected at one end to the bar 72 and at the other to the enclosure structure; and an air cylinder 76, pivotally supported by the enclosure with its piston 78 pivotally connected to the bar 72 to urge the dam member 40 toward the surface of the roll 10 and to maintain the slippers 44 (at the ends of the dam member) in rubbing contact therewith. In like manner, at each end of the lower air dam member 42 there is provided an air cylinder 80, pivotally supported by the enclosure structure and having its piston 82 pivotally connected to the lower dam member, for urging the dam member 42 toward the upper work roll 11 and maintaining the slippers 46 at the ends of the lower dam member in rubbing contact with the surface of that roll 11. The seal 64 and slideway 66 permit transverse movement of the air dam members toward and away from the mill rolls 10 and 11 while maintaining the integrity of confinement of region 34.

The upper air dam member 40 is a single rigid metal plate extending the full width of the enclosure 32, with slippers 44 mounted at its ends and in rubbing contact with the upper backup roll 10, as shown in FIG. 2; the slippers are so disposed, in relation to the member 40, as to maintain a reliably constant air gap of 0.060 to 0.100 inch between the dam member and the backup roll surface. The lower dam member 42 is constituted of a pair of vertically spaced but fixedly interconnected rigid metal plates **42*a* and 42*b* (FIGS. 1 and 2) both extending the full width of the enclosure; slippers 46 are mounted at the ends of the bottom plate 42*b* and are so disposed, in relation thereto, that when they are in rubbing contact with the upper work roll 11 they maintain a reliably constant air gap of 0.060 to 0.100 inch between the lower dam member and the work roll surface. The top plate 42*a* (omitted, for simplicity of illustration, in FIG. 3) moves with the bottom plate under the influence of the air cylinders 80, and acts as a shield for the air gap between the lower dam member and the work roll 11**, deflecting away from the gap the large volume of coolant sprayed on the work roll surface by the spray head nozzles, in order to prevent the coolant from drowning the air gap.

Figure 4:
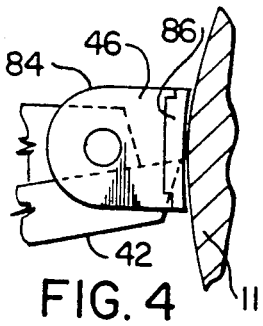
FIG. 4 is a still further enlarged fragmentary view, similar to FIG. 3, showing one of the slippers included in the structure illustrated in FIG. 3.
Figure 5:
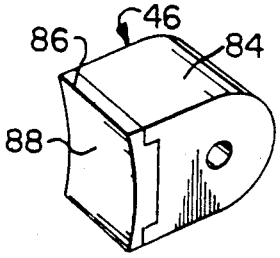
FIG. 5 is a perspective view of the slipper of FIG. 4.
Figure 6:
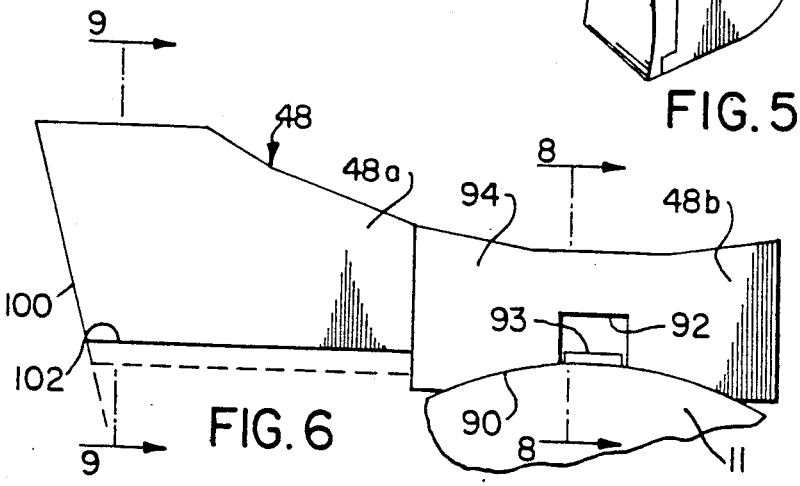
FIG. 6 is an enlarged elevational view of one of the end seal members associated with the enclosure of FIGS. 2 and 3.

The structure of the slippers 44 and 46 is exemplified by the slipper 46 shown in detail in FIGS. 4 and 5. This slipper has a metal body 84 and a sole 86 of "Teflon" low-friction material (polytetrafluoroethylene) with a curved exposed face 88 for smoothly engaging the surface of roll 10 in rubbing contact therewith. Each of the slippers is pivotable relative to the air dam member to which it is connected, to enable it to undergo appropriate variation in angular orientation for proper rubbing contact with rolls of different diameters.

As will now be understood, when the mill is in operation and the confined region 34 is evacuated to subatmospheric pressure through the vacuum duct 36, air flows into region 34 through the upper and lower air gaps respectively defined between member 40 and roll 10, and between member 42 and roll 11. The width of these gaps (e.g. 0.060 to 0.100 inch) is sufficient for such air flow, but narrow enough to stop coolant liquid from splashing out. The directions of surface rotation of rolls 10 and 11 passing the dam members 40 and 42 are both into the confined region 34; these directions of surface movement cooperate with the air flows through the gaps to oppose escape of coolant liquid from the confined region.

The movable mountings of the air dam members 40 and 42, and the air cylinders 76 and 80 urging their respective slippers into maintained rubbing contact with the rolls, enable ready positional adjustment of the dam members to conform properly to rolls of different diameters, within practicably large ranges (e.g. a work roll diameter range of 19 to 21 inches, and a backup roll diameter range of 50 to 52 inches). The slippers positively maintain the desired constant gap width for rolls of all diameters within such range. Thus, trouble-free alignment of the dam members relative to the rolls, and resultant assured air gap containment of coolant liquid at both the upper and the lower edges of the enclosure (i.e., both above and below the spray head 24), are achieved, with contact between the enclosure and the roll surfaces limited to the low-friction slipper faces adjacent the ends of the rolls.

Figure 7:
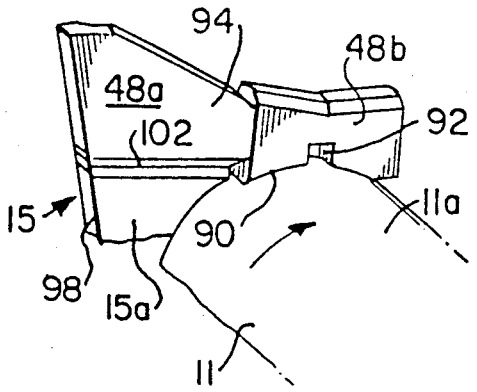
FIG. 7 is a fragmentary perspective view, to a smaller scale, showing the mounted position of the seal member of FIG. 6.
Figure 8:
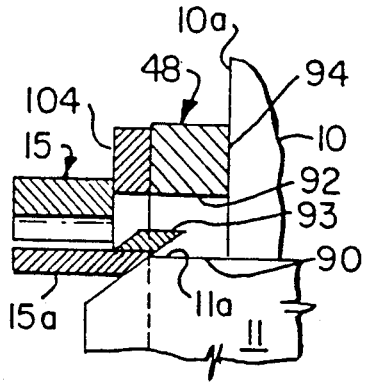
FIG. 8 is a fragmentary sectional elevational view taken along the line 8—8 of FIG. 6.
Figure 9:
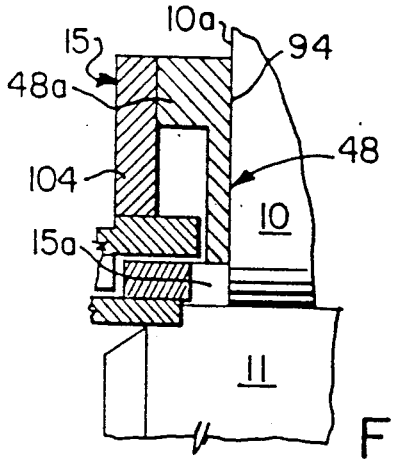
FIG. 9 is a fragmentary sectional elevational view taken along the line 9—9 of FIG. 6.

As illustrated in FIGS. 6-9, each of the end seal members 48 is constituted of two parts, **48*a* and 48*b*, both fabricated of glass-fiber-reinforced "Teflon" low friction material (polytetrafluoroethylene), with an arcuate downwardly-facing lower surface 90 for smoothly engaging the working (cylindrical) surface 11*a* of the upper work roll 10 in rubbing contact therewith at an end of the work roll, over a region extending on each side of the line 16 of work roll-backup roll contact. Specifically, the seal surface 90 engages the extremity of the work roll surface 11***a* exposed beyond the end of the somewhat shorter upper backup roll 10, as best seen in FIG. 8. A central notch 92 opening downwardly through surface 90 in the seal member 48 provides clearance for a spacer 93, which fills the space along the end chamfer of the work rolls. The size of the spacer 93 decreases as the work roll diameter decreases.

Each seal member also has a vertical face 94 for engaging the end surface 10*a* of the upper backup roll 10 in rubbing contact therewith, above and on both sides of the line of contact 16, i.e. above the projecting extremity of the somewhat longer work roll 11. The part 48*a* of the seal member projects toward the exit side of the mill, in maintained contact with the end surface 10*a* of the backup roll, to the side edge of the mill roll support structure 15 with which it is associated.

It is found that seal members made of the aforementioned material, and having the illustrated configuration and arrangement, wear very well in contact with the rolls.

The end sealing structure, as shown in FIG. 7, consists of three parts: seal member parts 48*a* and 48*b*, and a 4-inch-thick spacer plate 15*a* which is fixed to the inside surface of the work roll chock. The top edge 102 of spacer plate 15*a* is horizontal while the end edge 98 of the spacer plate is at an angle corresponding to the angle of the front edge of the side of the enclosure 32, thereby sealing the enclosure. Seal member part 48*a* is fitted to the top edge 102 of the spacer plate. End edge 100 of part 48*a* also matches the front angle of the enclosure thereby sealing the enclosure. Part 48*a* follows the vertical displacement of the spacer plate which in turn follows the vertical displacement of the chock as the diameters of the rolls are changed. The vertical position of end seal member part 48*b* is adjusted independently of the vertical position of part 48*a* by sliding part 48*a* along edge 103. Part 48*b* moves vertically according to changes in the diameter of the work roll. Parts 15*a*, 48*a* and 48*b* are in line; i.e., they are not offset relative to each other.

Each seal member 15*a*, 48*a* and 48*b* is fixedly but removably secured to the mill support structure 15, by any suitable means, for example including metal mounting elements 104 and bolts (not shown). The arrangement of the mounting means may be such as to enable the seal member to be adjusted to and held in an appropriately deformed condition so that the surface 90 makes a close seal with work roll surfaces of a range of differing diameters. The ability of the seal members to conform to changed roll diameters is facilitated by the fact that no adjustment is necessary to maintain sealing contact with backup rolls of differing diameters, since the seal members engage only the flat end surfaces of the backup rolls. The adjustability of the described seal members is such that two different sizes of seal members are sufficient to accommodate the full range of work roll diameters between 19 and 21 inches, for example. Thus, when the work roll diameter is changed, by replacement of one roll with another, either the seal member mountings are adjusted or the seal members are replaced with others of a different size, depending on the extent of the change in work roll diameter.

Referring now again to FIG. 3, the forward side edges of the end walls 60 of the enclosure 32 slant diagonally downwardly toward the mill rolls in conformity with the slanting line defined by edges 98 of plate 15*a* and 100 of seal member 48*a*. These enclosure side walls are so positioned that they are brought into snug, continuous engagement with the edges 98 and 100 of the plates 15*a* and seal members 48 at the opposite ends of the mill, when the enclosure is mounted in its operative position shown in FIGS. 1 and 3. Thus, the enclosure end walls 60, plates 15*a* and seal members 48 cooperatively provide tight end closure of the confined region 34, with the seal members in sealing contact with the upper work and backup rolls at the ends of the line of contact 16 between those rolls. This desired closure is easily maintained when the roll diameters are changed, because only the seal members require adjustment or replacement in such case, and even they must be conformed only to changes in diameter of the work roll.

The enclosure 32 in combination with the dam members, slippers and seal members described above is highly effective in preventing liquid coolant sprayed by head 24 from descending directly, on the exit side of the mill, onto the surface of metal strip being rolled. Nevertheless, some coolant liquid from head 24 is or may be carried around on the roll surfaces to the entry side of the mill, through the nip (line of contact 16) between rolls 10 and 11. The wiper 50 (FIGS. 1 and 12) serves to remove much of this liquid from the descending surface of work roll 11 on the mill entry side before it can reach the roll bite. During threading of the mill, the wiper 50 also prevents coolant liquid from being carried around through the roll bite by the work roll 11 and splashed on the undersurface of the enclosure 32, from which the liquid could later fall in drops (or be pulled down) onto metal strip being rolled, causing stains.

The wiper 50 includes a strip 106 of flexible, elastomeric material carried by a metal backing member 108 and extending along the full length of the surface of work roll 11, in continuous rubbing contact therewith, on the mill entry side between the line of contact 16 and the roll bite 18. The member 108 is positioned for engagement of the elastomer strip 106 with the roll surface, but (for any given roll diameter) is fixed relative to the roll; i.e., it is not positively urged toward the roll, as the direction of roll rotation past the wiper is effective to urge the strip 106 into constant rubbing contact with the roll surface.

Coolant liquid thus wiped by the strip 106 flows into a drain 110 (FIG. 1) for removal. Wall structure 112 extends from the wiper 50 to the drain, to conduct the wiped liquid into the drain and prevent it from falling to the surface of metal strip being rolled. The wall structure 112 may include a flexible portion or seal 114 to accommodate positional adjustment of the backing member 108 in accordance with changes in work roll diameter, the backing member being supported by a suitable adjustable mounting (not shown).

Figure 10:
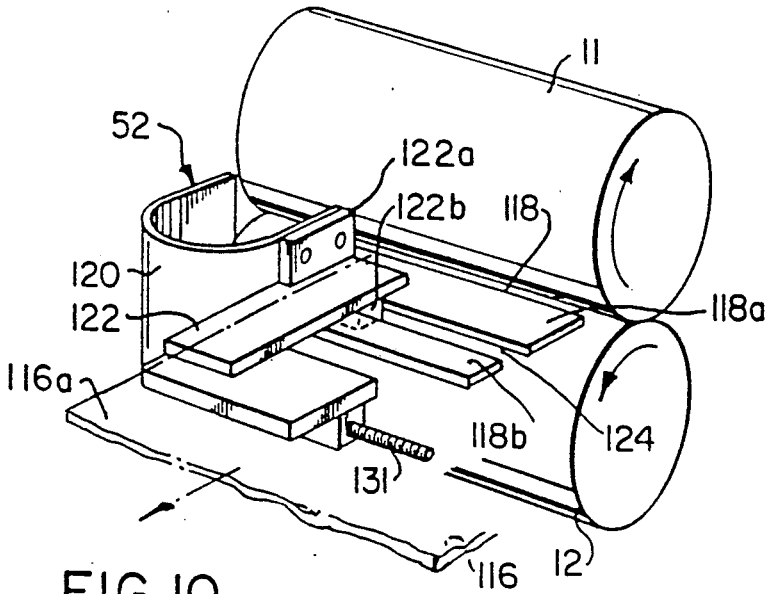
FIG. 10 is a fragmentary perspective view of the exit side of the mill of FIG. 1, showing one of the spray collectors of the FIG. 1 apparatus.
Figure 11:
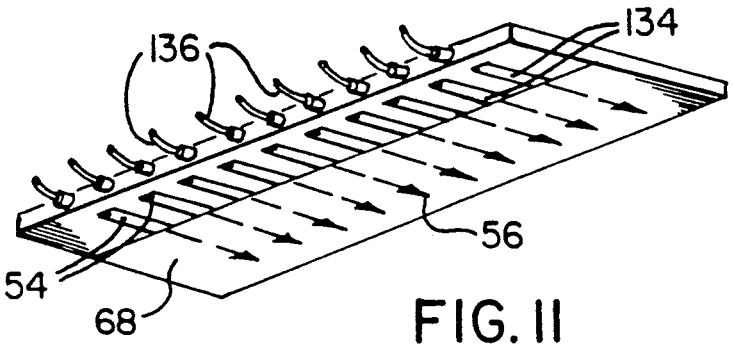
FIG. 11 is a fragmentary view, from below, of the under side of the enclosure of FIGS. 2 and 3, illustrating the air blow-off elements of the FIG. 1 apparatus.
Figure 12:
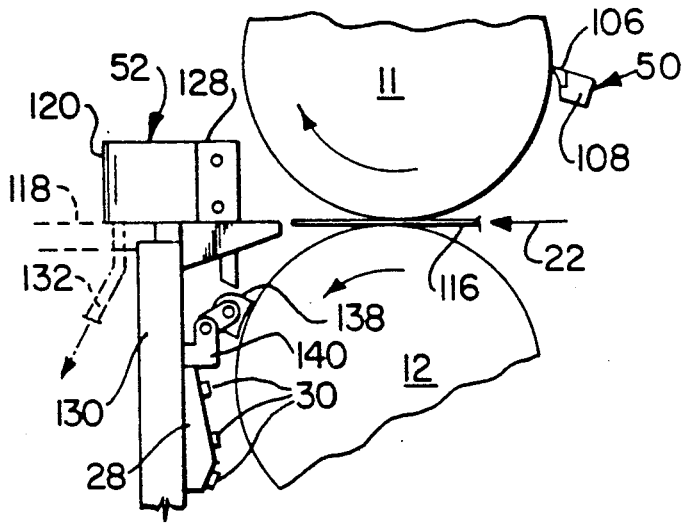
FIG. 12 is a fragmentary end elevational view illustrating the shield for the coolant-applying head for the lower work roll in the apparatus of FIG. 1, together with one of the spray collectors and the entry-side wiper for the upper work roll.

Unavoidably, however, some coolant liquid is carried into the roll bite 18 on the entry side of the mill. Since the length of the work rolls 11 and 12 is greater than the width of the metal strip reduced by the mill, there is a gap between the work rolls at each end of the roll bite, outwardly of the sides of the metal strip advancing through the roll bite. Coolant passing through the roll bite emerges from these gaps, on the exit side of the mill, in the form of sprays resembling rooster tails, owing to the velocity of the rolls. The aforementioned spray collectors 52 (one of which is shown in FIGS. 1, 10 and 12) are respectively positioned at the localities of the open end gaps of the roll bite on the exit side of the mill to prevent these "rooster tail" sprays from splashing back on and staining the upper surface of the metal strip 116 (FIGS. 10 and 12) being reduced.

Each collector 52 is associated with table structure 118 disposed on the exit side of the mill adjacent the roll bite but below the pass line, i.e., below the planar path of the strip 116 leaving the mill. The collector includes a flexible skirt or wall 120, bent into the shape of a U (as seen in plan view) opening toward the adjacent end gap of the roll bite on the mill exit side, and having major surfaces extending above the roll bite so as to surround laterally the region of the "rooster tail" spray ejected through that gap. The inboard end of the U-shaped flexible wall 120 is secured to a metal plate 122*a* (FIG. 10) mounted on a translatable plate 122 for movement therewith along the table 118 (lengthwise of the rolls, i.e. toward and away from the proximate ends of the rolls). The outboard end of wall 120 is secured to a metal plate 128 fixedly mounted on structure 130 (FIG. 12) near the ends of the rolls. A bar 122*b* mounted on the underside of plate 122 guides the plate 122 in a slot 124 defined between portions 118*a* and 118*b* of the table structure 118. A spray collector is mounted at each end of table 118; the inboard sides of the collectors are made to move in and out by rotation of lead screws 131. The rotation of the screws 131 is controlled by the mill computer, and is based on the width of the coil being rolled as entered by the mill operator. Within the region thus laterally confined by the wall 120, coolant liquid of the "rooster tail" spray collects and is withdrawn, for example by means of a drain 132 schematically shown in FIG. 12.

The spray collectors are effective to contain the "rooster tail" sprays and to shield the emerging rolled metal strip surface from them. The slidable plate 122 permits positional adjustment of the inboard side of the collector wall 120 to accommodate different widths of strip being rolled. Typically, the upright portion 122*a* of plate 122 (i.e., the portion secured to wall 120) is positioned about one inch outwardly of the proximate side edge 116*a* of the strip 116.

The blow-off elements 54 (FIGS. 1, 3 and 11) cooperate with the spray collectors to remove from the emerging metal strip surface any coolant liquid carried or deposited thereon, across the full width of the strip 116. Each of these elements 54 is an air nozzle mounted in a groove 134 formed in the downwardly-facing surface of the bottom wall 68 of the enclosure 32 and pointing toward the roll bite 18. The nozzles, each supplied with compressed air through a hose 136 from a suitable source (not shown), likewise point toward the roll bite. An array of these elements or nozzles 54 is distributed along the length of the roll bite to direct a blast 56 of compressed air into the roll bite on the mill exit side from above the emerging rolled strip 116, over the full width of the strip. The nozzles are so oriented that the air blast serves to drive any coolant liquid on the upper surface of the emerging strip (and especially at the edges 116*a* thereof) into the spray collectors 52. It will be seen, from FIG. 10, that the upstream vertical edge of collector wall 120 and plate portion 122*a* adjacent strip edge 116*a* is spaced from the work roll enabling coolant driven off the strip surface by the air blast to enter the collectors.

Figure 13:
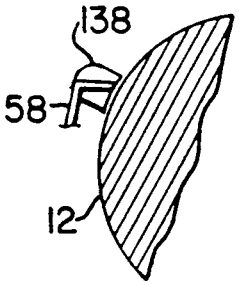
FIG. 13 is a fragmentary view similar to FIG. 12, illustrating further details of the shield associated with the lower work roll.

The lower surface of the emerging strip 116 is protected from coolant liquid from the lower spray head 28 (which cools the lower work roll 12) by means of the shield member 58 (FIGS. 1, 12 and 13). This member, disposed on the exit side of the mill between the pass line (path of strip 116) and the head 28, is a horizontally elongated rigid metal element with a profile in the shape of an inverted L, extending along the full length of work roll 12 in proximate but slightly spaced relation thereto. At its opposite ends, the member 58 carries two low friction "Teflon" material (polytetrafluoroethylene) bearing pads 138 (one being shown in FIGS. 12 and 13); the pads 138, which may be generally similar to the abovedescribed slippers 44 and 46, are in rubbing contact with the surface of work roll 12 to maintain a desired constant gap between member 58 and the roll surface. The member 58 and its associated pads 138 are pivotally mounted, at the opposite ends of the member, on fulcrum members 140 (one of which is shown in FIG. 12), for transverse movement toward and away from roll 12 to accommodate clanges in roll diameter. The arrangement of this mounting is such that the weight of member 58 holds the pads on the roll 12 without requiring hydraulic or other means to urge them into contact with the roll.

Owing to the direction of movement of the surface of roll 12 past the spray head 28 on the mill exit side, and the cooperating effect of gravity (roll 12 and head 28 being below the strip 116), both of which factors tend to carry coolant from head 28 away from strip 116, adequate containment of coolant liquid from head 28 to prevent staining of the strip lower surface is provided by the shielding effect of member 58 in keeping splashed coolant from the strip. On the downstream side of the shield member 58 (in the direction of strip advance) the structure of table 118 ensures maintained shielding of the strip from splashed coolant.

The operation of the described apparatus of the invention may now be readily understood. Metal (e.g. aluminum) strip to be reduced is threaded through the roll bite 18, and the rolls are set in operative position, all in conventional manner. As the strip is thereafter continuously advanced through the mill, the work rolls are continuously cooled and lubricated by aqueous coolant/lubricant sprayed by heads 24 and 28. With the interior of enclosure 32 maintained at subatmospheric pressure by the vacuum means 36, air is drawn inwardly through the gaps between air dam members 40 and 42 and the upper backup and work rolls, respectively, and this inflow of air cooperates with the directions of roll movement past the air dam members to contain coolant/lubricant from head 24. The slippers 44 and 46, and the hydraulic cylinders urging them against the rolls 10 and 11, establish and maintain appropriate constant air gaps. Seal members 48, and the mill roll support structure 15, cooperate with the side walls of the enclosure 32 to complete the containment of coolant from head 24 on the mill exit side. At the same time, the wiper 50 removes coolant/lubricant from the surface of roll 11 on the entry side of the mill; collectors 52 shield the emerging strip from "rooster tail" sprays at the ends of the roll bite; and the air blast elements 54 drive off any coolant/lubricant on the strip surface emerging from the roll bite. The lower surface of the strip is shielded by member 58 from sprayed or splashed coolant/lubricant from the lower head 28.

When it is necessary to change roll diameters, the seal members 48 are adjusted or replaced as necessary to conform to the new work roll diameter. The air dam members, with their air cylinders and the features of arrangement that enable their transverse position to be varied while maintaining the integrity of confinement of the interior of enclosure 32, are self-aligning to accommodate the new roll diameters and to provide the same constant-width air gaps. The shield member 58 is likewise self-aligning. The wiper 50 can easily be repositioned without special or close control of alignment, and the spray collectors 52 are readily adjustable to conform to changes in width of strip being rolled.

Thus, the above-described combination of elements incorporated in the illustrated embodiment of the invention very effectively protects the surfaces of metal strip being rolled in the mill, against stain-producing contact with coolant liquid from the spray heads, in a highly reliable manner requiring minimal maintenance, and is readily and simply adaptable to changes in roll diameter and/or strip width.

It is to be understood that the invention is not limited to the features and embodiments hereinabove set forth, but may be carried out in other ways without departure from its spirit.

We claim:

1. In a rolling mill for metal reduction, including upper and lower work rolls defining a roll bite through which the metal is passed, for reduction, from an entry side to an exit side of the mill; at least one backup roll, in contact with the upper work roll along a line of contact; means supporting said backup and work rolls; and means for applying liquid coolant to the outer surface of said upper work roll on only the exit side of the mill above said roll bite; coolant containment apparatus comprising:

(a) enclosure means disposed on the exit side of the mill, generally surrounding the coolant-applying means and open toward said work roll outer surface, for confining a region containing the coolant-applying means and adjacent surface portions of said one backup roll and said upper work roll so as to restrict fluid flow into and out of said region, said enclosure means having upper and lower edges respectively facing said one backup roll and said upper work roll;

(b) vacuum means for withdrawing air from the interior of the enclosure to maintain a subatmospheric air pressure in said region;

(c) means for collecting and withdrawing coolant liquid from the interior of the enclosure;

(d) a rigid upper air dam member disposed at the upper edge of said enclosure means and extending, parallel to the axis of said one backup roll, in closely adjacent but spaced relation to the outer surface of said one backup roll, above said coolant-applying means, over substantially the entire length of said one backup roll, for defining therewith a narrow gap through which air is drawn into said region over said backup roll outer surface when said region is at a subatmospheric pressure;

(e) a rigid lower air dam member disposed at the lower edge of said enclosure means and extending, parallel to the axis of said upper work roll, in closely adjacent but spaced relation to the outer surface of said upper work roll, below said coolant-applying means but above said roll bite, over substantially the entire length of the upper work roll, for defining therewith a narrow gap through which air is drawn into said region over the work roll outer surface when the interior of said region is at a subatmospheric pressure;

(f) a first pair of slippers, connected to and respectively disposed at opposite ends of said upper air dam member in rubbing contact with said backup roll outer surface, for maintaining said upper air dam member at a constant spacing from said one backup roll;

(g) a second pair of slippers, connected to and respectively disposed at opposite ends of said lower air dam member in rubbing contact with said work roll outer surface, for maintaining said lower air dam member at a constant spacing from said upper work roller;

(h) a pair of seal members, mounted on said roll-supporting means and respectively disposed at opposite ends of said upper work roll, each of said seal members being in rubbing contact with an end portion of said work roll outer surface and an adjacent end surface of said one backup roll at an adjacent said line of contact, for cooperating with said enclosure means in confining said region as aforesaid; and (i) means for moving said upper and lower air dam members with their associated pairs of slippers in directions transverse to the lengths of said air dam members to enable use of the apparatus with rolls of differing diameters.

2. Cooling containment apparatus as defined in claim 1, wherein said lower air dam member comprises a pair of interconnected, vertically spaced plates.

3. Coolant containment apparatus as defined in claim 1, wherein said pairs of slippers includes soles fabricated of polytetrafluoroethylene for engaging the roll surfaces with which the slippers are in rubbing contact.

4. Coolant containment apparatus as defined in claim 1, wherein said seal members are fabricated of fiber-reinforced polytetrafluoroethylene.

5. Coolant containment apparatus as defined in claim 4, wherein each of said seal members has an arcuate lower surface for engaging said work roll outer surface.

6. Coolant containment apparatus as defined in claim 1, further including flexible wiper means in rubbing contact with said work roll outer surface on the entry side of the mill along substantially the entire length of the upper work roll for removing liquid coolant from said work roll outer surface.

7. Coolant containment apparatus as defined in claim 1, further including a pair of spray collector means respectively disposed adjacent opposite ends of said roll bite on the exit side of the mill for collecting liquid coolant, emerging as a spray from the roll bite outwardly of the metal being reduced in the mill, to shield the metal from contact with the spray.

8. Coolant containment apparatus as defined in claim 7, wherein each said spray collector means comprises a rigid plate mounted for movement lengthwise of the roll bite, and a generally U-shaped flexible wall opening toward the roll bite and having opposite ends respectively anchored to the rigid plate and fixedly mounted adjacent the proximate end of the roll bite, said plate being positionable adjacent but outwardly of a lateral edge of the metal being reduced in the mill and being adjustable in position to accommodate various widths of metal being reduced.

9. Coolant containment apparatus as defined in claim 8, further including blow-off means disposed on the exit side of the mill for directing a flow of air into the roll bite above the metal being reduced, to blow any coolant liquid carried on the upper surface of said metal into said collector means, said collector means being arranged to receive coolant liquid blown from the metal surface by said blow-off means.

10. Coolant containment apparatus as defined in claim 9, wherein said blow-off means comprises a plurality of nozzles mounted on said enclosure means adjacent the lower edge thereof for blowing compressed air into the roll bite, said nozzles being disposed and arranged to provide a flow of compressed air over substantially the full length of the roll bite.

11. Coolant containment apparatus as defined in claim 1, wherein said mill includes means for applying liquid coolant to the outer surface of said lower work roll on only the exit side of the mill below said roll bite, said apparatus further comprising a rigid shield member of L-shaped cross-section extending, parallel to the axis of said lower work roll, in closely spaced relation to the outer surface of said lower work roll along substantially the entire length thereof between the roll bite and the means for applying coolant to the lower work roll outer surface, to shield the metal being reduced from liquid from said last-mentioned coolant applying means; a pair of pads respectively connected to said shield member adjacent opposite ends of the shield member and in rubbing contact with the lower work roll outer surface, for maintaining the shield member at a constant spacing from the lower work roll outer surface; and means pivotally mounting said shield member for movement transversely of its length to enable use of the apparatus with rolls of different diameters.

12. In a rolling mill for metal reduction, including upper and lower work rolls defining a roll bite through which the metal is passed, for reduction, from an entry side to an exit side of the mill; at least one backup roll, in contact with the upper work roll along a line of contact; means supporting said backup and work rolls; means for applying liquid coolant to the outer surface of said upper work roll on only the exit side of the mill above said roll bite; and means for applying liquid coolant to the outer surface of said lower work roll on only the exit side of the mill below said roll bite; coolant containment apparatus comprising:

(a) enclosure means disposed on the exit side of the mill, generally surrounding the first-mentioned coolant-applying means and open toward said work roll outer surface, for confining a region containing the first-mentioned coolant-applying means and adjacent surface portions of said one backup roll and said upper work roll so as to restrict fluid flow into and out of said region, said enclosure means having upper and lower edges respectively facing said one backup roll and said upper work roll;

(b) vacuum means for withdrawing air from the interior of the enclosure to maintain a subatmospheric air pressure in said region;

(c) means for collecting and withdrawing coolant liquid from the interior of the enclosure;

(d) a rigid upper air dam member disposed at the upper edge of said enclosure means and extending, parallel to the axis of said one backup roll, in closely adjacent but spaced relation to the outer surface of said one backup roll, above said first-mentioned coolant-applying means, over substantially the entire length of said one backup roll, for defining therewith a narrow gap through which air is drawn into said region over said backup roll outer surface when said region is at a subatmospheric pressure;

(e) a rigid lower air dam member disposed at the lower edge of said enclosure means and extending, parallel to the axis of said upper work roll, in closely adjacent but spaced relation to the outer surface of said upper work roll, below said first-mentioned coolant-applying means but above said roll bite, over substantially the entire length of the upper work roll, for defining therewith a narrow gap through which air is drawn into said region over the work roll outer surface when the interior of said region is at a subatmospheric pressure;

(f) a first pair of slippers, connected to and respectively disposed at opposite ends of said upper air dam member in rubbing contact with said backup roll outer surface, for maintaining said upper air dam member at a constant spacing from said one backup roll;

(g) a second pair of slippers, connected to and respectively disposed at opposite ends of said lower air dam member in rubbing contact with said work roll outer surface, for maintaining said lower air dam member at a constant spacing from said upper work roll;

(h) a pair of seal members, mounted on said roll-supporting means and respectively disposed at opposite ends of said upper work roll, each of said seal members being in rubbing contact with an end portion of said work roll outer surface and an adjacent end surface of said one backup roll at and adjacent said line of contact, for cooperating with said enclosure means in confining said region as aforesaid;

(i) flexible wiper means in rubbing contact with said work roll outer surface on the entry side of the mill along substantially the entire length of the upper work roll for removing liquid coolant from said work roll outer surface;

(j) a pair of spray collector means respectively disposed adjacent opposite ends of said roll bite on the exit side of the mill or collecting liquid coolant, emerging as a spray from the roll bite outwardly of the metal being reduced in the mill, to shield the metal from contact with the spray;

(k) blow-off means disposed on the exit side of the mill for directing a flow of air into the roll bite above the metal being reduced, to blow any coolant liquid carried on the upper surface of said metal into said collector means, said collector means being arranged to receive coolant liquid blown from the metal surface by said blow-off means;

(l) a rigid shield member extending, parallel to the axis of said lower work roll, in closely spaced relation to the outer surface of said lower work roll along substantially the entire length thereof between the roll bite and the means or applying coolant to the lower work roll outer surface, to shield the metal being reduced from liquid from said last-mentioned coolant applying means; and (m) means for moving said upper lower air dam members with their associated pairs of slippers in directions transverse to the lengths of said air dam members to enable use of the apparatus with rolls of differing diameters.

13. Coolant containment apparatus as defined in claim 12, wherein said lower air dam member comprises a pair of interconnected, vertically spaced plates; wherein said pairs of slippers include soles fabricated of polytetrafluoroethylene for engaging the roll surfaces with which the slippers are in rubbing contact; and wherein each of said seal members is fabricated of fiber-reinforced polytetrafluoroethylene and has an arcuate lower surface for engaging said work roll outer surface.

14. Coolant containment apparatus as defined in claim 13, wherein each said spray collector means comprises a rigid plate mounted for movement lengthwise of the roll bite, and a generally U-shaped flexible wall opening toward the roll bite and having opposite ends respectively anchored to the rigid plate and fixedly mounted adjacent the proximate end of the roll bite, said plate being positionable adjacent but outwardly of a lateral edge of the metal being reduced in the mill and being adjustable in position to accommodate various widths of metal being reduced; and wherein said blow-off means comprises a plurality of nozzles mounted on said enclosure means adjacent the lower edge thereof for blowing compressed air into the roll bite, said nozzles being disposed and arranged to provide a flow of compressed air over substantially the full length of the roll bite.

15. Coolant containment apparatus as defined in claim 14, further including a pair of pads respectively connected to said shield member adjacent opposite ends of the shield member and in rubbing contact with the lower work roll outer surface, for maintaining the shield member at a constant spacing from the lower work roll outer surface; wherein said shield member is of L-shaped cross-section; and further including means pivotally mounting said shield member for movement transversely of its length to enable use of the apparatus with rolls of different diameters.

16. In a rolling mill for metal reduction, including upper and lower work rolls defining a roll bite through which the metal is passed, for reduction, from an entry side to an exit side of the mill; at least one backup roll, in contact with the upper work roll along a line of contact; means supporting said backup and work rolls; and means for applying liquid coolant to the outer surface of said upper work roll on only the exit side of the mill above said roll bite; coolant containment apparatus comprising:

(a) enclosure means disposed on the exit side of the mill, generally surrounding the coolant-applying means and open toward said work roll outer surface, for confining a region containing the coolant-applying means and adjacent surface portions of said one backup roll and said upper work roll so as to restrict fluid flow into and out of said region, said enclosure means having upper and lower edges respectively facing said one backup roll and said upper work roll;

(b) vacuum means for withdrawing air from the interior of the enclosure to maintain a subatmospheric air pressure in said region;

(c) means for collecting and withdrawing coolant liquid from the interior of the enclosure;

(d) a rigid upper air dam member disposed at the upper edge of said enclosure means and extending, parallel to the axis of said one backup roll, in closely adjacent but spaced relation to the outer surface of said one backup roll, above said coolant-applying means, over substantially the entire length of said one backup roll, for defining therewith a narrow gap through which air is drawn into said region over said backup roll outer surface when said region is at a subatmospheric pressure, said upper air dam member being movable transversely of its length relative to said enclosure while maintaining the integrity of confinement of said region;

(e) a rigid lower air dam member disposed at the lower edge of said enclosure means and extending, parallel to the axis of said upper work roll, in closely adjacent but spaced relation to the outer surface of said upper work roll, below said coolant-applying means but above said roll bite, over substantially the entire length of the upper work roll, for defining therewith a narrow gap through which air is drawn into said region over the work roll outer surface when the interior of said region is at a subatmospheric pressure, said lower air dam member being movable transversely of its length relative to said enclosure while maintaining the integrity of confinement of said region;

(f) a first pair of slippers, connected to and disposed at spaced localities along said upper air dam member in rubbing contact with said backup roll outer surface, for maintaining said upper air dam member at a constant spacing from said one backup roll;

(g) a second pair of slippers, connected to and disposed at spaced localities along said lower air dam member in rubbing contact with said work roll outer surface, for maintaining said lower air dam member at a constant spacing from said upper work roll; and (h) means for urging said upper and lower air dam members toward said upper backup roll and said upper work roll, respectively, to maintain said first and second pairs of slippers in rubbing contact with the surfaces of said upper backup roll and said upper work roll, respectively.

17. In a rolling mill for metal reduction, including upper and lower work rolls defining a roll bite through which the metal is passed, for reduction, from an entry side to an exit side of the mill; at least one backup roll, in contact with the upper work roll along a line of contact; means supporting said backup and work rolls; and means for applying liquid coolant to the outer surface of said upper work roll on only the exit side of the mill above said roll bite; coolant containment apparatus comprising:

(a) enclosure means disposed on the exit side of the mill, generally surrounding the coolant-applying means and open toward said work roll outer surface, for confining a region containing the coolant-applying means and adjacent surface portions of said one backup roll and said upper work roll so as to restrict fluid flow into and out of said region, said enclosure means having upper and lower edges respectively facing said one backup roll and said upper work roll, and end walls respectively disposed adjacent opposite ends of said rolls; and (b) a pair of seal members, mounted on said roll-supporting means and respectively disposed at opposite ends of said upper work roll, each of said seal members being in rubbing contact with an end portion of said work roll outer surface and an adjacent end surface of said one backup roll at and adjacent said line of contact, for cooperating with said end walls of said enclosure means in confining said region as aforesaid.

18. In a rolling mill for metal reduction, including upper and lower work rolls defining a roll bite through which the metal is passed, for reduction, from an entry side to an exit side of the mill, and means for applying liquid coolant to the outer surface of at least said upper work roll, coolant containment apparatus comprising a pair of spray collector means respectively disposed adjacent opposite ends of said roll bite on the exit side of the mill for collecting liquid coolant, emerging as a spray from the roll bite outwardly of the metal being reduced in the mill, to shield the metal from contact with the spray, each said spray collector means comprising a rigid plate mounted for movement lengthwise of the roll bite, and a generally U-shaped flexible wall opening toward the roll bite and having opposite ends respectively anchored to the rigid plate and fixedly mounted adjacent the proximate end of the roll bite, said plate being positionable adjacent but outwardly of a lateral edge of the metal being reduced in the mill and being adjustable in position to accommodate various widths of metal being reduced.

19. Coolant containment apparatus as defined in claim 18, further including blow-off means disposed on the exit side of the mill for directing a flow of air into the roll bite above the metal being reduced, over at least substantially the full width of the roll bite, to blow any coolant liquid carried on the upper surface of said metal into said collector means, said collector means being arranged to receive coolant liquid blown from the metal surface by said blow-off means.

20. In a rolling mill for metal reduction, including upper and lower work rolls defining a roll bite through which the metal is passed, for reduction, from an entry side to an exit side of the mill, and means for applying liquid coolant to the outer surface of at least said lower work roll, coolant containment apparatus comprising a rigid shield member extending, parallel to the axis of said lower work roll, in closely spaced relation to the outer surface of said lower work roll along substantially the entire length thereof between the roll bite and the means for applying coolant to the lower work roll outer surface, to shield the metal being reduced from liquid from said last-mentioned coolant applying means, and a pair of pads connected to said shield member at locations spaced along the shield member and in rubbing contact with the lower work roll outer surface, for maintaining the shield member at a constant spacing from the lower work roll outer surface, said shield member being pivotally mounted for movement, with the pads, toward and away from the lower work roll.

* * * * *